US005599498A

United States Patent [19]

Oh

[11] Patent Number: 5,599,498

[45] Date of Patent: Feb. 4, 1997

[54] METHOD FOR CONTINUOUSLY SUPPLYING ACTIVATED AIR AND APPARATUS THEREFOR

[76] Inventor: Byeung O. Oh, 10-9, Haewha-Dong, Jongro-Gu, Seoul, Rep. of Korea

[21] Appl. No.: 388,538

[22] Filed: Feb. 14, 1995

[30] Foreign Application Priority Data

Oct. 21, 1994 [KR] Rep. of Korea ..... 1994-26922

[51] Int. Cl.[6] ..... A61L 9/20

[52] U.S. Cl. ..... 422/4; 422/24; 422/121; 422/122; 422/186; 55/256; 95/226

[58] Field of Search ..... 422/4, 22, 24, 422/120, 121, 122, 186, 186.3; 55/256; 95/226; 126/638, 639, 678

[56] References Cited

U.S. PATENT DOCUMENTS 1,975,426 10/1934 John ..... 422/22
4,478,699 10/1984 Halmann et al. ..... 422/186
4,514,377 4/1985 Symons et al. ..... 422/186
5,250,258 10/1993 Oh ..... 422/22

*Primary Examiner*—Robert J. Warden
*Assistant Examiner*—Theresa T. Snider
*Attorney, Agent, or Firm*—Lowe, Price, LeBlanc & Becker

[57] ABSTRACT

An apparatus for continuously supplying air into an indoor space is disclosed. The apparatus includes a sunlight collector for activating carbon dioxide contained in the air by irradiating sunlights thereto, a reservoir for storing and discharging the activated carbon dioxide, the reservoir holding a reaction solution capable of exchange reaction with the carbon dioxide and a unit for reducing the carbon dioxide concentration in the air to a level non-hazardous to a human body. The apparatus may further include an infrared radiation lamp that can produce infrared rays to maintain the electric conductivity of the reaction solution within a preselected range at night or under bad weather conditions. A method is provided whereby atmospheric air passes through the reservior to undergo exchange reactions with the reaction solution. The method produces atmospheric air containing carbon dioxide molecules in a higher energy state, and directs the air toward the indoor space.

27 Claims, 2 Drawing Sheets

5599498

METHOD FOR CONTINUOUSLY SUPPLYING ACTIVATED AIR AND APPARATUS THEREFOR

FIELD OF THE INVENTION

The present invention is directed to a method for continuously supplying air that is activated in a high energy state by sunlight to an indoor space of, e.g., buildings or apartments and an apparatus therefor.

DESCRIPTION OF THE PRIOR ART

To keep an indoor space clean and pleasant, various types of environmental devices have been widely employed in buildings, factories and the like, examples of which include an air conditioning system, a clean room apparatus and a small-size air purification device. Most of these devices are intended to eliminate pollutants present in the air.

Recently, attempts have been made to increase the amount of sunlight that reaches the indoor space, particularly when constructing a modern building or a luxurious apartment. Although the natural sunlight is so introduced are somewhat effective in activating the indoor air, the degree of activation is not satisfactory because most light comes from an artificial electric light source. Moreover, it becomes almost impossible to activate the indoor air by natural sunlight during a cloudy or rainy day.

U.S. Pat. No. 5,250,258 discloses an apparatus for activating carbon dioxide molecules contained in the atmospheric air by use of infrared radiation. Since a great amount of electric energy is consumed to produce the infrared radiation, the apparatus is less suitable for use in a large-size building which necessarily needs a large volume of the activated air circulating through the indoor space.

SUMMARY OF THE INVENTION

Accordingly, it is an object of the present invention to provide an apparatus and process for continuously supplying highly activated air into an indoor space in a less expensive and non-weather-dependent manner.

In accordance with one aspect of the present invention, there is provided an apparatus for continuously supplying an air that is activated in a high energy state into an indoor space, comprising a sunlight collector for collecting sunlight to activate carbon dioxide contained in the air, a reaction reservoir for storing the carbon dioxide activated by the sunlight and allowing the stored carbon dioxide to be emitted into the air in a lower energy state, the reaction reservoir holding a reaction solution adapted for exchange reaction with the activated carbon dioxide and a concentration modulator tank for adjusting concentration of the carbon dioxide contained in the air to a non-hazardous level before the air is admitted into the indoor space. The reaction reservoir may preferably be provided with an infrared radiation lamp to irradiate infrared rays in the air during inclement weather or at night. An ultraviolet lamp may be further provided at an outlet of the reservoir to sterilize the air.

In another aspect of the invention, there is provided a process for continuously supplying an air activated in a high energy state into an indoor space, comprising the steps of providing air containing carbon dioxide, activating the carbon dioxide to a high energy state by irradiating natural sunlight thereto, passing the air through a, reservoir holding a reaction solution to cause at least a part of the activated carbon dioxide to undergo exchange reactions with the reaction solution, and directing the air containing the remainder of the activated carbon dioxide toward the indoor space. The inventive process may further comprise the step of controlling the concentration of the carbon dioxide in the air which is admitted into the indoor space.

BRIEF DESCRIPTION OF THE DRAWINGS

Other objects, features and advantages of the invention will become apparent from the following description of the preferred embodiment taken in conjunction with the drawings in which.

DESCRIPTION OF THE PREFERRED EMBODIMENT

Figure 1:
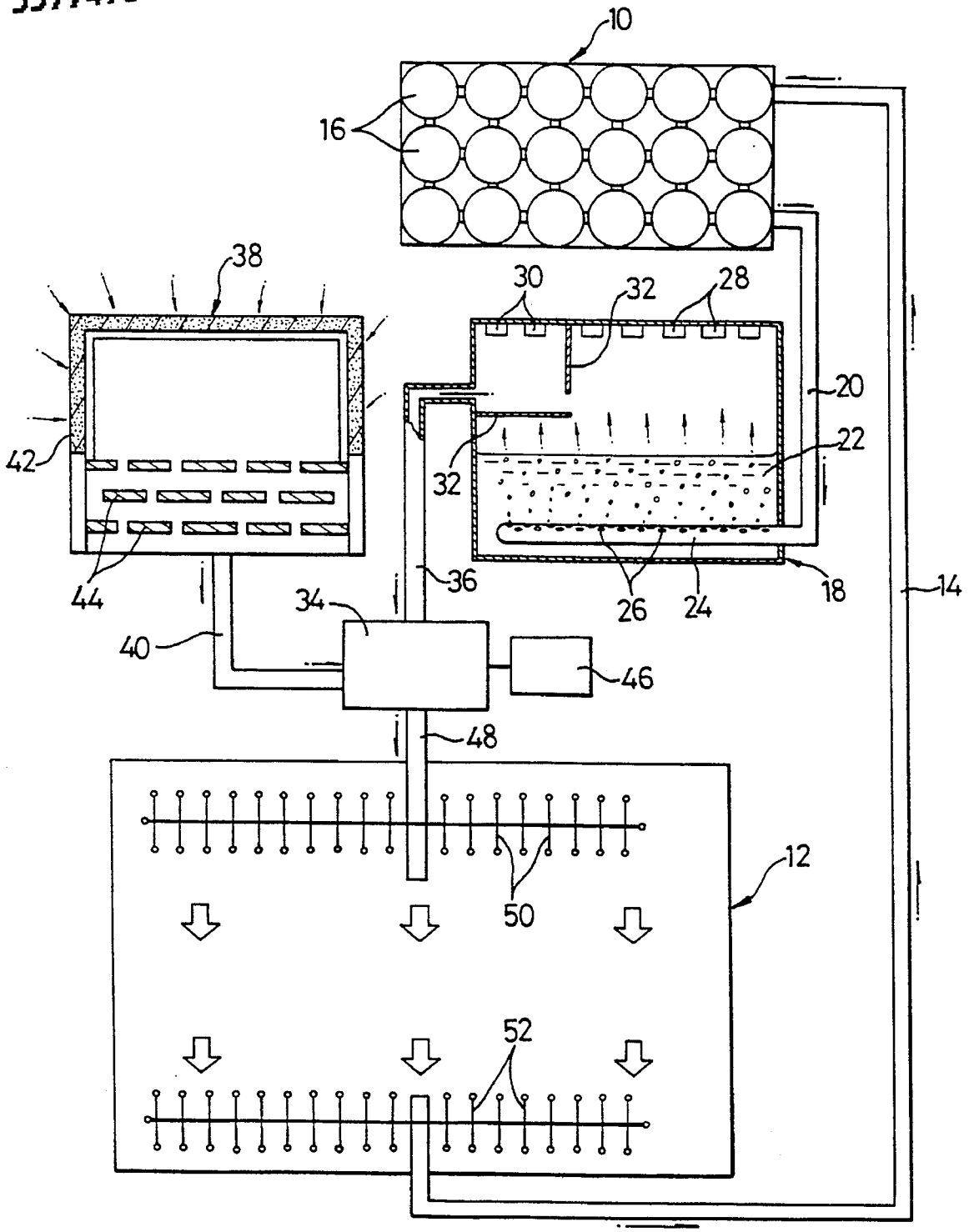
FIG. 1 is a schematic diagram of the air supplying apparatus in accordance with the present invention.

Referring now to FIG. 1, a sunlight collector 10 is located on the roof of a building (not shown for simplicity) to collect solar energy from the sunlight incident thereon. The sunlight collector 10 communicates with a building compartment 12 via a conduit 14 such that the indoor air can be fed to the sunlight collector 10. As the indoor air passes through the sunlight collector 10, carbon dioxide molecules present in the air can absorb the solar energy to become activated in a high energy state. Inasmuch as other components in the air than the carbon dioxide have a symmetrical molecular structure, they hardly absorb the solar energy.

The sunlight collector 10 should preferably be made of an amorphous silicon glass of 200 to 300 μm in thickness in order to improve the solar energy absorption efficiency thereof, unlike the typical solar cells usually constructed from GaAs-based substances. As is well known, the sun has a surface temperature of 6000° K. or so and continues to produce sunlight whose energy level ranges from 1.0 to 2.5 eV. The amorphous silicon glass is known to have an energy level ranging from 1.6 to 1.8 eV and has the ability to absorb the sunlight whose wavelength is between 0.5 and 1.25 μm. To assure the solar energy absorption efficiency to be maximized, the sunlight collector 10 may be fabricated from a plurality of glass beads 16 that are extendibly interconnected together, which enables the air to be retracted and expanded repeatedly.

The air which contains the carbon dioxide molecules activated by the sunlight is admitted through a conduit 20 into an exchange reaction reservoir 18 that holds reaction solution 22 therein. Connected to the conduit 20 is a feeder pipe 24 which extends along the bottom of the reaction reservoir 18 and remains submerged under the reaction solution 22. The feeder pipe 24 has a multiplicity of micropores 26 that serve to evenly distribute the air to thereby enhance exchange reaction between the reaction solution 22 and the air. It is preferred that an aqueous carbonate solution containing, e.g., $Na_2CO_3$, $K_2CO_3$ or $NaHCO_3$, should be used as the reaction solution 22, while other aqueous solutions may work well.

It is widely recognized that the chemical affinity of isotopes is closely associated with their mass. The difference in mass tends to heavily affect the chemical and molecular reactivity of the isotopes. Assuming that two compounds having different reaction speed are involved in a chemical reaction, the light-weight isotope in one compound can be exchanged with the heavy-weight isotope in the other compound under a given reaction condition. This is mainly because the equilibrium constant of one compound differs from that of the other compound. The exchange reaction set forth above may be advantageously employed in concentrating an isotope of light-weight. In case of the carbon dioxide, the isotope exchange reaction can be given as follows:

$$^{13}CO_2+H^{12}CO_3^- \leftrightarrows {}^{12}CO_2+H^{13}CO_3^{31}$$

Further, if the activated carbon dioxide is denoted by $^{*12}CO_2$, the chemical reaction occuring in the reservoir 18 may be expressed by the following equation:

$$^{*12}CO_2+H^{12}CO_3^- \leftrightarrows {}^{12}CO_2+H^{12}CO_3^{31}$$

If the exchange reaction in the reservoir 18 is rightward, at least a part of the high energy carbon dioxide molecules is dissolved in the reaction solution 22. On the other hand, should an inverse exchange reaction take place in the reservoir 18, the low energy carbon dioxide molecules present in the air are exchanged with the high energy ones which were dissolved in the reaction solution 22 during the course of the rightward reaction.

In other words, on a clear sunny day, the high energy carbon dioxide molecules in the air fed from the sunlight collector 10 are partially subjected to a rightward exchange reaction with the reaction solution 22 as they pass through the reaction reservoir 18. This ensures that a part of the high energy carbon dioxide molecules are left in the reaction solution, with the rest supplied to the building compartment 12 along with the air stream. To the contrary, at night or in bad weather, the carbon dioxide molecules in the air cannot be activated by the sunlight collector 10 and, therefore, remain in a low energy state as it is admitted into the reaction reservoir 18. As a result, the inverse exchange reaction occurs in the reaction reservoir 18 so that the low energy carbon dioxide molecules in the air can be exchanged with the high energy carbon dioxide molecules stored at the reaction solution 22, making it possible to continuously supply, even at night, the air containing the high energy carbon dioxide molecules into the building compartment 12 in a non-weather-dependent manner. This means that the reaction solution 22 is capable of retaining the solar energy, i.e., the high energy carbon dioxide molecules, temporarily for emission at a later time.

Figure 2:
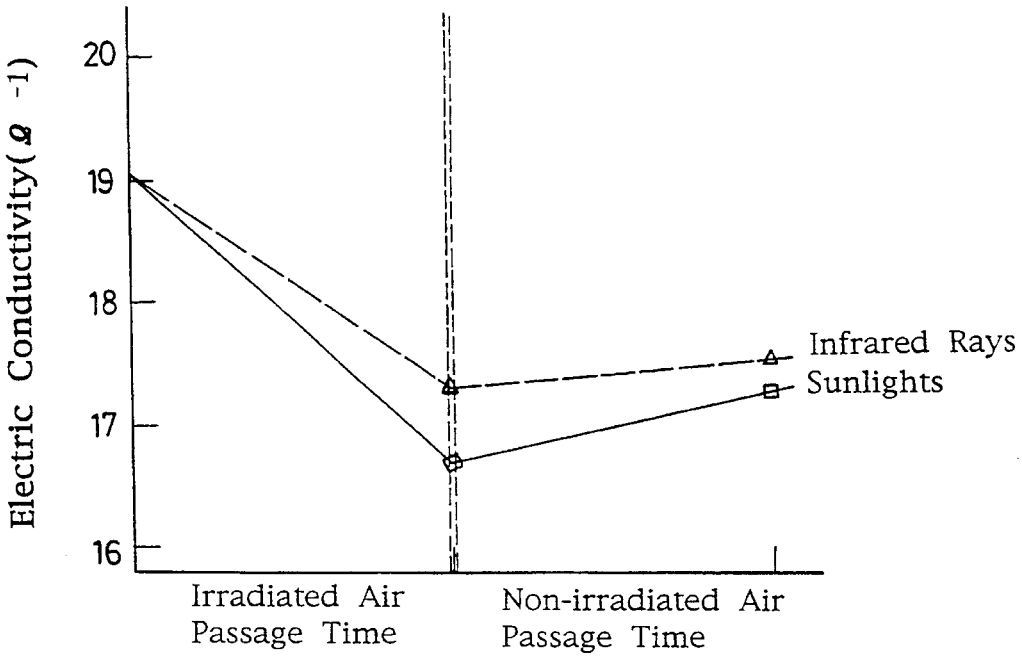
FIGS. 2(*a*) and 2(*b*) are graphical representations showing variations in the electric conductivity and the specific resistance, respectively, of aqueous $Na_2CO_3$ solution before and after passing the air through the reaction solution for one hour.
Figure 2:
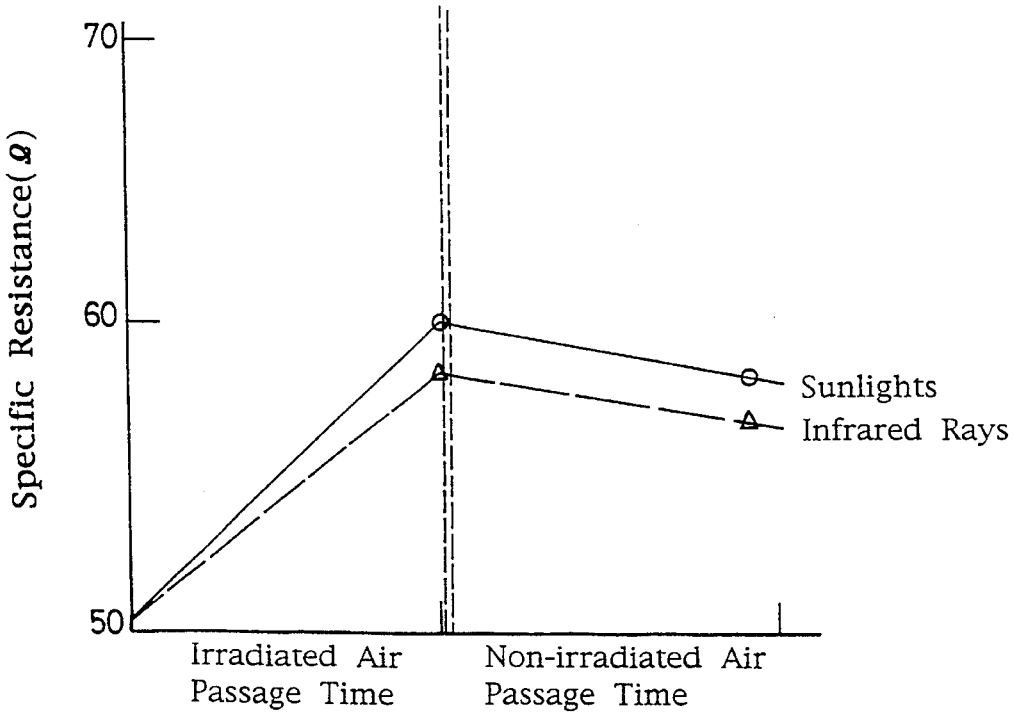

To empirically confirm the energy retention capability of the reaction solution, the inventor has conducted a series of experiments by using, as the reaction solution, 0.01M of aqueous $Na_2CO_3$ solution of 20° C. The atmospheric air which contains 8% of carbon dioxide molecules was collected in a Mylar bag to have same pass through the reaction solution with or without irradiation of the sunlight and the infrared rays for one hour. The specific resistance and the electric conductivity for the reaction solution were measured before and after passing the air through the reaction solution. The results are shown in Table 1 and FIG. 2.

TABLE 1

| Experiment No. | Test Conditions | Specific Resistance (Ω) | Electric Conductivity ($\Omega^{-1}$) |
|---|---|---|---|
| 1 | Before Passing the Air | 50.40 | 19.10 |
| 2 | After Passing the Air with One Hour Irradiation of Sunlights | 60.00 | 16.70 |
| 3 | After Passing the Non-irradiated Air through the Reaction Solution Used in Ex. No. 2 | 58.20 | 17.35 |
| 4 | After Passing the Air with One Hour Irradiation of Infrared Rays | 58.40 | 17.27 |
| 5 | After Passing the Non-irradiated Air through the Reaction Solution Used in Ex. No. 4 | 56.90 | 17.54 |

As is apparent in Table 1, the electric conductivity of the aqueous $Na_2CO_3$ solution is as high as $19.10\Omega^{-1}$ before the air is passed therethrough. The conductivity is, however, reduced to $16.70\Omega^{-1}$ upon passage of the sunlight-irradiated air for one hour. It is presumed that such a reduction in the conductivity may stem from the exchange reaction of $H^{12}CO_3^-$in the $CO_3$—. solution with $^{*12}CO_2$ the air to become $^{*12}CO_3^-$. In the event that the non-irradiated indoor air is subsequently passed through the reaction solution used in Experiment No. 2, the conductivity is increased up to $17.35\Omega^{-1}$, which indicates that the high energy carbon dioxide molecules were emitted from the reaction solution. In this way, the reaction solution can store the solar energy at the shiny daytime and release the stored solar energy at night or under the bad weather condition.

To maximize the solar energy storage capacity, it is preferred that the reaction solution be in a saturated state. The aqueous $Na_2CO_3$ solution can be produced by way of dissolving sodium carbonate in water. One way of obtaining the sodium carbonate is to make sodium hydroxide absorb either an artificial isotope of the carbon dioxide, e.g., $^{14}CO_2$, or the carbon dioxide itself which may be created in the course of burning a withered tree, for instance.

Since the electric conductivity of the reaction solution would measure the solar energy storage capacity, it should be strictly controlled within a range of from 15 to $20\Omega^{-1}$. The reaction reservoir 18 may be preferably made of hardened glass or ceramic which is excellent in durability, anti-contamination property and erosion resistance. Furthermore, the feeder pipe 24 projecting into the reaction reservoir 18 should preferably have the micropores of 10 mm or so in diameter that are uniformly distributed along the length of the feeder pipe 24.

At the time when no sunlight having energy of 1.0 to 2.5 eV is available, namely, at night or under a bad weather condition as in winter, the electric conductivity of the reaction solution has a tendency to rise beyond a permissible limit, i.e., $19.10\Omega^-$in case of the aqueous $Na_2CO_3$ solution, thus destroying the energy retention capability of the reaction solution in its entirety. To cope with such situation, it is desirable to install an array of 250 W infrared lamps 28 on the ceiling of the reaction reservoir 18 so as to provide infrared rays, as an alternative to the sunlight. As can be seen in Table 1 and FIG. 2, the infrared radiation energy is quite efficiently absorbed in the reaction solution 22, although the absorbance is somewhat less than that of the solar energy.

Additionally or alternatively, ultraviolet lamps 30 of 15 to 30 W may be provided at the exit of the reaction reservoir 18 to sterilize microorganisms possibly present in the air. With a view to improving the sterilization effect, a mesh-like synthetic resin partition 32 may be fixedly mounted around the ultraviolet lamps 30.

The air activated in a high energy state is directed toward a concentration modulator tank 34 via a conduit 36 which interconnects the reaction reservoir 18 and the concentration modulator tank 34. As recommended by the World Health Organization, the carbon dioxide concentration in the indoor air should be kept below 0.5% so as not to have harmful effect to the human body. The concentration modulator tank 34 plays a role in diluting the high carbon dioxide content air with the outdoor air which is fed from an outdoor air intake tank 38 through a conduit 40, so that the partial pressure of carbon dioxide can become about 3.8 mmHg with the partial pressure of oxygen 152 mmHg.

The outdoor air intake tank 38 includes an air filter 42 for removing dirts or other pollutants from the outdoor air admitted into the tank 38 and an array of activated carbon and paraffin layers 44 arranged one above another for further purifying the outdoor air which was passed through the air filter 42. It will suffice to introduce the outdoor air once for half an hour unless the carbon dioxide concentration in the air is exceedingly high. At the carbon dioxide concentration of 0.5% or more, however, the outdoor air will have to be forcedly introduced into the concentration modulator tank 34 by way of energizing a circulation pump 46.

The circulating air whose carbon dioxide concentration remains less than 0.5% is subsequently admitted into the building compartment 12 via a conduit 48. A supply duct 50 is provided at the ceiling of the building compartment 12 to uniformly distribute the circulating air over a wide area of the building compartment 12. Provided on the bottom of the building compartment 12 is a discharge duct 52 that allows the indoor air to be discharged to the sunlight collector 10.

In case where the inventive apparatus is installed on a modern building, it would be possible to employ an automatic recirculation controller that has a key board for entering necessary data, a sensor designed to detect the electric conductivity of the reaction solution, the carbon dioxide concentration in the indoor air and the air flow rate, a monitor for displaying the detected information and a printer for selectively printing the displayed information While the invention has been shown and described with reference to a preferred embodiment, it should be apparent to those skilled in the art that many changes and modifications may be made without departing from the scope of the invention as defined in the claims.

What is claimed is:

1. An apparatus for continuously supplying air containing activated carbon dioxide comprising:

a sunlight collector for activating carbon dioxide contained in air;

a reaction reservoir communicating with said sunlight collector comprising a reaction solution said reaction solution being capable of exchange reacting with at least a part of the activated carbon dioxide; and a concentration modulator tank receiving the air containing the activated carbon dioxide, wherein the reservoir provides air containing activated carbon dioxide and wherein the tank adjusts carbon dioxide concentration in the air to a nonhazardous level.

2. The apparatus of claim 1, further comprising a conduit connecting an indoor space and the sunlight collector.

3. The apparatus of claim 1, wherein the sunlight collector comprises an amorphous silicon glass.

4. The apparatus of claim 3, wherein the amorphous silicon glass is from about 200 to 300 um thick.

5. The apparatus of claim 1, wherein the sunlight collector is fabricated from a plurality of glass beads extendibly interconnected together.

6. The apparatus of claim 1, further comprising a conduit connecting the sunlight collector and the reaction reservoir.

7. The apparatus of claim 1, further comprising a feeder pipe which extends along a bottom of the reaction reservoir and remains submerged under the reaction solution.

8. The apparatus of claim 7, wherein the feeder pipe comprises sufficient micropores to evenly distribute the air to the reaction solution.

9. The apparatus of claim 1, wherein the reaction solution comprises an aqueous carbonate solution.

10. The apparatus of claim 9, wherein the aqueous carbonate solution is selected from the group consisting of $Na_2CO_3$, $K_2CO_3$ and $NaHCO_3$.

11. The apparatus of claim 10, wherein the aqueous carbonate solution is a $Na_2CO_3$ solution, and the $Na_2CO_3$ is obtained from making sodium hydroxide absorb an artificial isotope of carbon dioxide such as $^{14}CO_2$, or carbon dioxide created in the course of burning withered trees.

12. The apparatus of claim 1, wherein the reaction solution is substantially in a saturated state.

13. The apparatus of claim 1, wherein the reaction reservoir further comprises one or more ultraviolet lamps.

14. The apparatus of claim 13, wherein the ultraviolet lamps are about 15 to 30 W lamps.

15. The apparatus of claim 1, wherein the reaction reservoir further comprises at least one array of infrared lamps for the purpose of adjusting the electric conductivity of the reaction solution.

16. The apparatus of claim 1, wherein the reaction solution has an electrical conductivity between about 15 to about 20 ohms−1.

17. The apparatus of claim 1, wherein the reaction reservoir further comprises a mesh-like synthetic resin partition fixedly mounted around lamps.

18. The apparatus of claim 1, further comprising a conduit connecting the reaction reservoir and the concentration modulator tank.

19. The apparatus of claim 1, further comprising an outdoor air intake tank.

20. The apparatus of claim 19, wherein the outdoor air intake tank further comprises an air filter and an array of activated carbon and paraffin layers.

21. The apparatus of claim 1, further comprising a circulation pump.

22. The apparatus of claim 1, further comprising a conduit connecting the concentration modulator tank and an indoor space.

23. The apparatus of claim 1, further comprising a supply duct.

24. The apparatus of claim 1, further comprising a discharge duct.

25. A process for continuously supplying air containing activated carbon dioxide comprising the steps of:

a) passing air containing carbon dioxide through a sunlight collector to activate the carbon dioxide contained therein;

b) reacting the activated air with a reaction solution to allow at least part of the activated carbon dioxide to exchange react with the carbon dioxide contained within the reaction solution; and c) introducing the activated air to an indoor space.

26. The process of claim 25, further comprising the step of adjusting the concentration of the carbon dioxide in the air to a non-hazardous level before introducing the air into the indoor space.

27. The method of claim 26, wherein the concentration of carbon dioxide is below 0.5%.

* * * * *